US006874407B2

(12) United States Patent
Doleschel et al.

(10) Patent No.: US 6,874,407 B2
(45) Date of Patent: Apr. 5, 2005

(54) PISTON ROD-LESS LINEAR DRIVE

(75) Inventors: Bernd Doleschel, Wendlingen (DE); Markus Weber, Esslingen (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/703,997

(22) Filed: Nov. 6, 2003

(65) Prior Publication Data

US 2004/0094032 A1 May 20, 2004

(30) Foreign Application Priority Data

Dec. 3, 2002 (DE) ..... 102 58 147

(51) Int. Cl.[7] ..... F01B 29/00
(52) U.S. Cl. ..... 92/88
(58) Field of Search ..... 92/88, 129

(56) References Cited

U.S. PATENT DOCUMENTS 5,469,775 A 11/1995 Stoll et al.
6,308,821 B1 10/2001 Asai et al.
6,338,294 B1 1/2002 Wagner et al.
6,505,542 B2 * 1/2003 Weberruss et al. ..... 92/88
2002/0023534 A1 2/2002 Weberruss et al.

FOREIGN PATENT DOCUMENTS

DE 19802775 A1 11/1998
EP 1182359 A1 2/2002
WO WO 02/068827 A1 9/2002

* cited by examiner

*Primary Examiner*—Thomas E. Lazo
(74) *Attorney, Agent, or Firm*—Hoffmann & Baron, LLP

(57) ABSTRACT

A piston rod-less linear drive has an elongated housing containing a guide slide moving in the longitudinal direction. The connection between the entraining member and the guide slide is with the interposition of an abutment unit attached to the guide slide, such abutment unit furthermore serving to limit the path of movement of the guide slide.

21 Claims, 3 Drawing Sheets

PISTON ROD-LESS LINEAR DRIVE

BACKGROUND OF THE INVENTION

The invention relates to a piston rod-less linear drive comprising an elongated housing defining a receiving space for a drive part able to be moved in the longitudinal direction of the housing, such drive part being kinematically coupled by way of a entraining member, extending through a longitudinal slot in the housing, with a guide slide, which runs in the longitudinal direction of the housing on a linear guide attached to the housing.

THE PRIOR ART

In the case of a linear drive of this type disclosed in the European patent publication 1,182,359 A1 the entraining member has its outer end section fitting in a recess facing away from the guide slide and is permanently screwed to the guide slide directly. This direct and permanent screw attachment may lead to strains in the system which increase liability to wear. In order to limit the path of movement the guide slide can at its end cooperate with the end plates of the housing.

SHORT SUMMARY OF THE INVENTION

One object of the invention is accordingly to provide a piston rod-less linear drive with an optimized kinematic coupling between the entraining member and the guide slide.

In order to achieve these and/or other objects appearing from the present specification, claims and drawings, present invention provides a piston rod-less linear drive of the type initially mentioned such that the entraining member is coupled with the guide slide with the interposition of an abutment means, which is secured to the guide slide and is made separately from the guide slide, the abutment means on the one hand cooperating with counter abutments on the housing for limiting the setting movement of the guide slide and on the other hand transmitting the drive force from the entraining member to the guide slide in a manner free of play.

The distribution of forces in the case of the transmission of the drive force from the drive part to the guide slide thus does not take place directly between the entraining member and the guide slide but indirectly and by way of the separate abutment means placed between the entraining member and the guide slide. Cooperating with counter abutments on the housing this abutment means serves to limit the setting path of the guide slide, which is able to be moved in relation to the housing, and assumes a double function, since it additionally functions as a force transmitting means between the entraining member and the guide slide. Assembly of the linear drive is accordingly substantially simplified, because the relative adjustment between the entraining member and the guide slide on the one hand and on the other hand the correct positioning on the guide slide of the abutment means may take place in a single working operation and taking into account interacting features. Moreover, using such a design leads to a relatively simple structure with a small number of components.

Further advantageous developments of the invention are defined in the claims.

The abutment means is preferably arranged on a lateral face of the guide slide, which is substantially rectangular in plan and more especially on the top side is provided with a support face serving for the attachment of components to be moved.

It has turned out to be particularly convenient to provide the abutment means with two individual abutment units, which are responsible for limiting the setting path in respectively one of the two possible directions of motion of the guide slide, the two abutment units each having one of two abutment faces, which are oppositely aligned in the longitudinal direction of the housing, such abutment face being able to cooperate with a counter abutment projecting into the setting path and being arranged on the housing. Dependent on the particular structure the entraining member can be arranged on merely one or simultaneously on both abutment units. A design with a more particularly low overall height is produced, if the two abutment units are arranged one after the other in the longitudinal direction of the housing. Furthermore, an extremely adaptable and readily modified arrangement is possible, if the two abutment units are attached independently of each other on the guide slide, same being able to be adjusted in relation to each other in the longitudinal direction of the housing to an adjustable extent.

It is an advantage if, respectively in the direction of the impact force acting on them, the two abutment units are respectively supported on a counter abutment in an interlocking or positively fitting manner and not merely frictionally on the guide slide. Accordingly, the entraining member and therefore also the drive part connected with the entraining member for the transmission of force, is decoupled from the impact forces, something which has a favorable effect on the working life. Moreover, it is possible to ensure that even on the occasion of a violent impact there will be no change in the relative position between the abutment face provided on the abutment unit and the guide slide.

If the entraining member is only attached to one abutment unit, the two abutment units will be conveniently fixedly joined together after making the desired adjustment so that between them in the finally installed state the transmission of force will be possible in the longitudinal direction of the housing. This ensures that the relative position between the entraining member and the guide slide will not be changed in the longitudinal direction of the housing even if between these two components there is a substantial transmission of force owing to high acceleration force and/or to heavy loads to be shifted. The connection between the two abutment units preferably takes place by a joint such as a bonded or welded joint.

The abutment unit provided for the direct attachment of the entraining member is in this case more particularly integral. It has a holding section connected with the entraining member and an abutment face serving for cooperation with one of the counter abutments, which are integral components of the respective abutment unit.

The attachment of the entraining member to only one abutment unit is to be recommended in the case of linear drives with a small overall size. More particularly in the case of large overall sizes a simultaneous attachment of the entraining member to both abutment units is preferred. In this connection the two abutment units will respectively possess an abutment part provided to cooperate with an counter abutment and a holding part provided for attachment of the entraining member, the two parts of a respective abutment unit being adjustable in the longitudinal direction of the housing in relation to one another during assembly so that an independent adjustment of the abutment part and of the holding part of the respective abutment unit is possible. Accordingly there is a high degree of adaptability as regards the attachment of the entraining member, an adjustment here not affecting the positioning of the abutment parts.

In order to produce a reliable connection between the individual components the abutment part and the holding part of a respective abutment unit are best connected together after adjustment and attachment additionally by bonding or welding and accordingly held in position. It is preferred to use a bond.

Preferably the entraining member has a coupling section fitting between the attachment parts, which are spaced apart in the longitudinal direction of the housing, of the two abutment units and is joined in a play-free manner with both attachment parts in the longitudinal direction of the housing. Thus there is a highly exact transmission of force with a sufficiently high degree of positioning precision.

The measures provided for the attachment of the entraining member are more particularly such that the entraining member is able to be attached on the associated abutment unit in a transverse plane of the housing, which is at a right angle to the longitudinal direction of the housing, in different relative positions. In the case of screw attachment this may for example be ensured by having a slot in the entraining member to render possible the necessary degrees of freedom. In any case such measures are extremely suitable in order to compensate of inaccuracies in manufacture or assembly.

The linear drive may be in the form of an electrically operated design and for example have a lead screw drive, which as a drive part is able to be shifted and is in the form of a lead screw nut. However a particularly advantageous design is one in which the drive part is in the form of a piston and the actuating force is produced by fluid power. In such a case the longitudinal slot is provided with a band-like sealing means to prevent uncontrolled loss of fluid through the longitudinal slot.

Further advantageous developments and convenient forms of the invention will be understood from the following detailed descriptive disclosure of embodiments thereof in conjunction with the accompanying drawings.

LIST OF THE SEVERAL VIEWS OF THE FIGURES

DETAILED ACCOUNT OF WORKING EMBODIMENTS OF THE INVENTION

Figure 1:
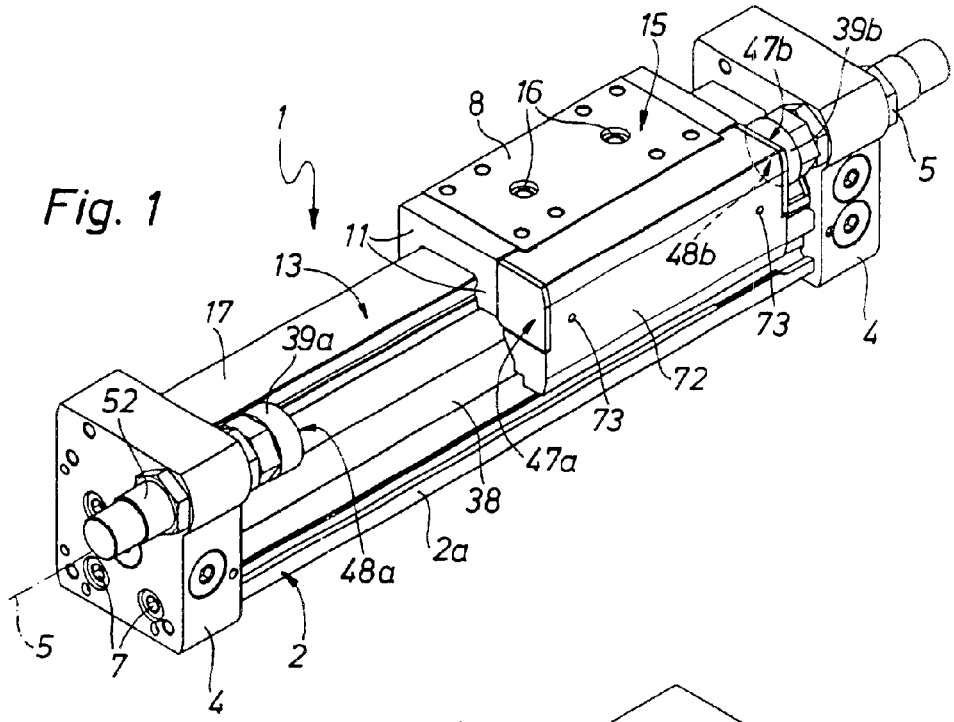
FIG. 1 shows a preferred first embodiment of the linear drive in accordance with the invention in a perspective elevation.

The first working example possesses a piston rod-less linear drive generally referenced 1 and in a design suitable for fluid power operation. It is more especially designed for operation by compressed air.

The linear drive has an longitudinal housing 2 with a housing tube 2*a* defining in its interior a preferably cylindrical receiving space, said tube 2*a* having respective cover plates 4 at its ends.

In the interior of the receiving space 3 there is a drive part 6 able to be moved in the longitudinal direction 5 of the housing, indicated in chained lines, such drive part being in the form of a piston which divides the receiving space 3 into two axially sequential working chambers in a fluid-tight manner. By way of connection ports 7, which in the working example are jointly provided on a single end plate 4, it is possible for the supply and removal of pressure medium to take place to and from the working spaces. Thus the drive part 6 may be caused to perform a drive movement in the longitudinal direction 5 of the housing.

The drive movement of the drive part 6 may be transmitted from a point outside the housing to the a guide slide 8, which is kinematically coupled by means of an entraining member 12 with the drive part 6 for movement in the longitudinal direction of the housing.

The guide slide 8 runs on the linear guide 13 in the longitudinal direction 5 of the housing. The linear guide 13 for this purpose is aligned to be parallel to the housing 2. Preferably, the linear guide 13 is arranged on the outer face of the housing tube 2*a*, it being connected in the working example along its entire length with the housing tube 2*a*. It is preferably constituted by a guide rail 17, which is attached to the outer face of the housing 2, more particularly without using screws. The working example represents a design in which the guide rail 17 is more especially produced by extrusion integrally with the housing tube 2*a*.

The guide slide 8 more particularly possesses a U-like cross section and straddles the linear guide 13. In this respect it has its two limbs 11, which flank the linear guide 13 on opposite longitudinal sides, cooperating with a respective guide section 23 provided on the associated longitudinal side of the linear guide 13. The latter are preferably formed by guide tracks, which extend along the entire length of the linear guide 13. The slide limbs 11 may be provided with plain or anti-friction bearing means (not illustrated in detail for guiding cooperation with the guide section 23.

Accordingly the guide slide 8 is supported in all directions on the linear guide 13 with the exception of the longitudinal direction 5 of the housing. At its top side facing away from the linear guide 13 it has a support face 15, on which attachment means 16 are provided so that the support face 15 may have a load secured to it, which is to be shifted.

At one point on the periphery of the receiving space 3 the wall of the housing tube 2*a* is provided with a longitudinal slot 26. It has an inner opening 27 in the receiving space 3 and its opposite outer opening 28 is at the longitudinal outer face 31 of the housing tube 2*a*. Preferably the longitudinal slot 26 extends along the entire length of the housing tube 2*a*. It runs in a slot plane 32 indicated in chained lines, which in the working example extends obliquely in a guide plane defined by one of the two guide sections 23 of the linear guide 13, more particularly at an acute angle 33 indicated in FIG. 3. The outer slot opening 28 faces the guide plane 24.

The above mentioned entraining member 12 extends right through the slot 26. It is so kinematically coupled by an inner end section, herein termed the attachment section 34, with the drive part 6 that with it a drive unit 35 is formed, which is always ganged for joint movement in the longitudinal direction 5 of the housing. In other words the entraining member 12 takes part in the linear movement of the drive part 6 in a play-free manner.

In the working embodiment the attachment section 34 is fork-like in shape and slipped over the drive part 6 from the side so that in the longitudinal direction 5 of the housing there is a play-free, interlocking or positive connection.

By way of its end section, which lies outside the longitudinal slot 26 and is termed the coupling section 36, the entraining member 12 also indirectly kinematically coupled in a play-free manner and with the interposition of an abutment means 37, which is separate from the guide slide, in the longitudinal direction 5 of the housing with the guide slide 8. Thus the drive part 6, the entraining member 12, the abutment means 37 and the guide slide 8 constitute a ganged unit, which can only be moved en bloc, the distribution of the drive force from the entraining member 12 to the guide slide 8 not being direct but indirect with the interposition of the abutment means 37.

More particularly when it is a question of a linear drive 1 in the form of a fluid power design, the longitudinal slot 26 will be provided with a band-like, flexurally bending sealing means 38 able to seal off the 26 on either side of the entraining member 12 from the surroundings so that the desired action of fluid power is possible. Adjacent to the entraining member 12 the sealing means 38 is moved clear of the longitudinal slot 26 in order to permit the entraining member 12 to extend through the slot. In the working embodiment the sealing means 38 comprises an inner sealing band 42 responsible for the above mentioned seal, such band being able to cooperate with the flanks of the longitudinal slot at the opening 27 of the slot. In the working embodiment there is furthermore an outer covering band 43, which at the outer slot opening 28 prevents ingress of dirt into the longitudinal slot 26.

The abutment means 37 performs a double function. On the one hand, as already indicated, it transmits the drive force, aligned in the longitudinal direction 5 of the housing, from the entraining member 12 to the guide slide 5 in a play-free manner. On the other hand it serves for limiting the setting movement of the guide slide 8—which may also be termed a stroke—in relation to the housing 2, since when the desired end positions of the guide slide 8 are reached it cooperates with counter abutments 39*a* and 39*b* attached to the housing.

Figure 3:
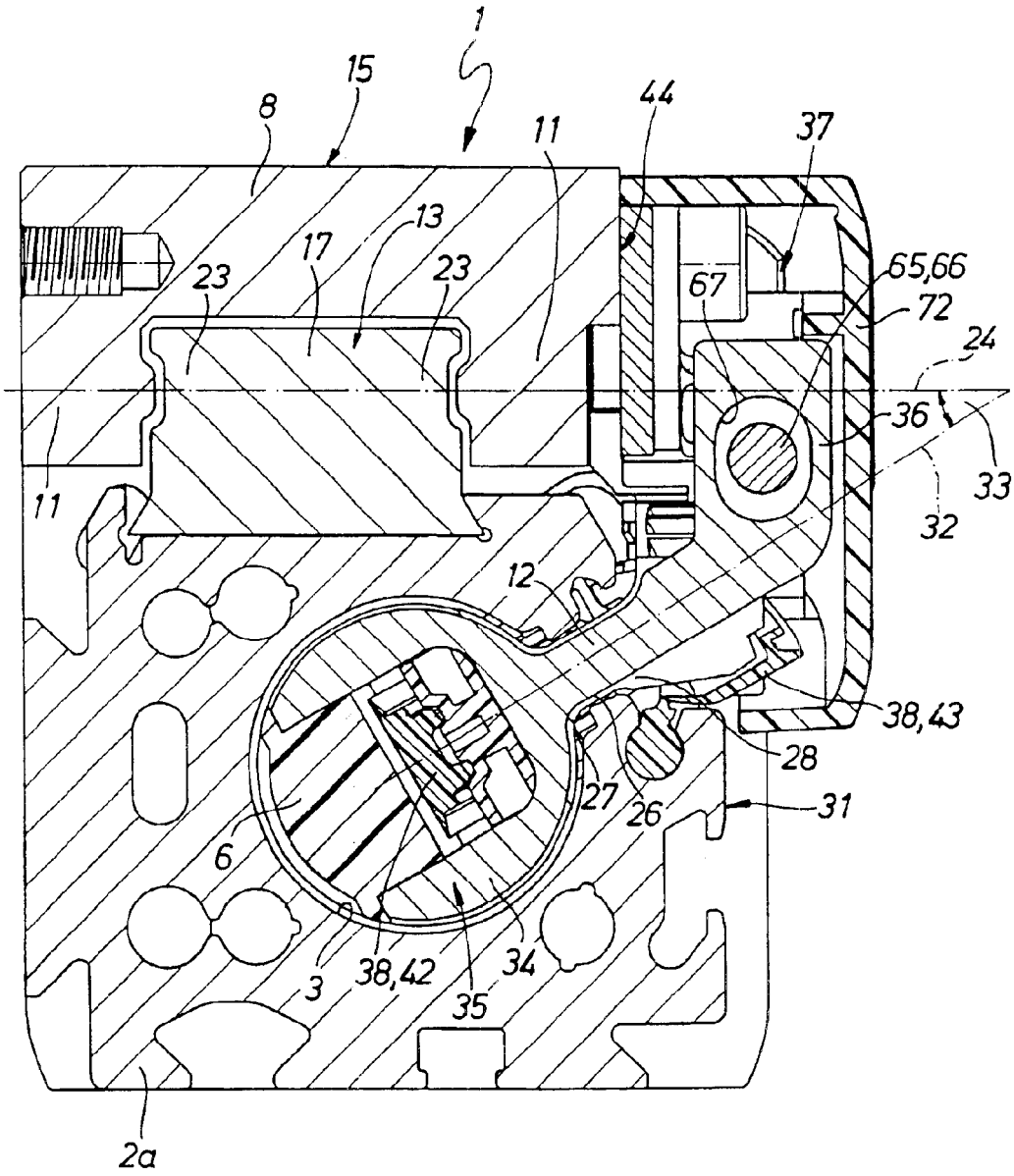
FIG. 3 represents a cross section taken through the linear drive on the section line III—III at the entraining member.

The abutment means 37 is mounted on a side face, herein termed a mounting face 44, of the guide slide 8. It is a question here of one of the two longitudinal side faces of the guide slide 8 which generally has a substantially rectangular plan. The opposite side face of the guide slide 8 lacks any abutment means. As shown in FIG. 3 the abutment means 37 is preferably at the same level as the guide plane 24 and adjacent to the intersection between the guide plane 24 and the oblique plane 32 of the slot.

Figure 4:
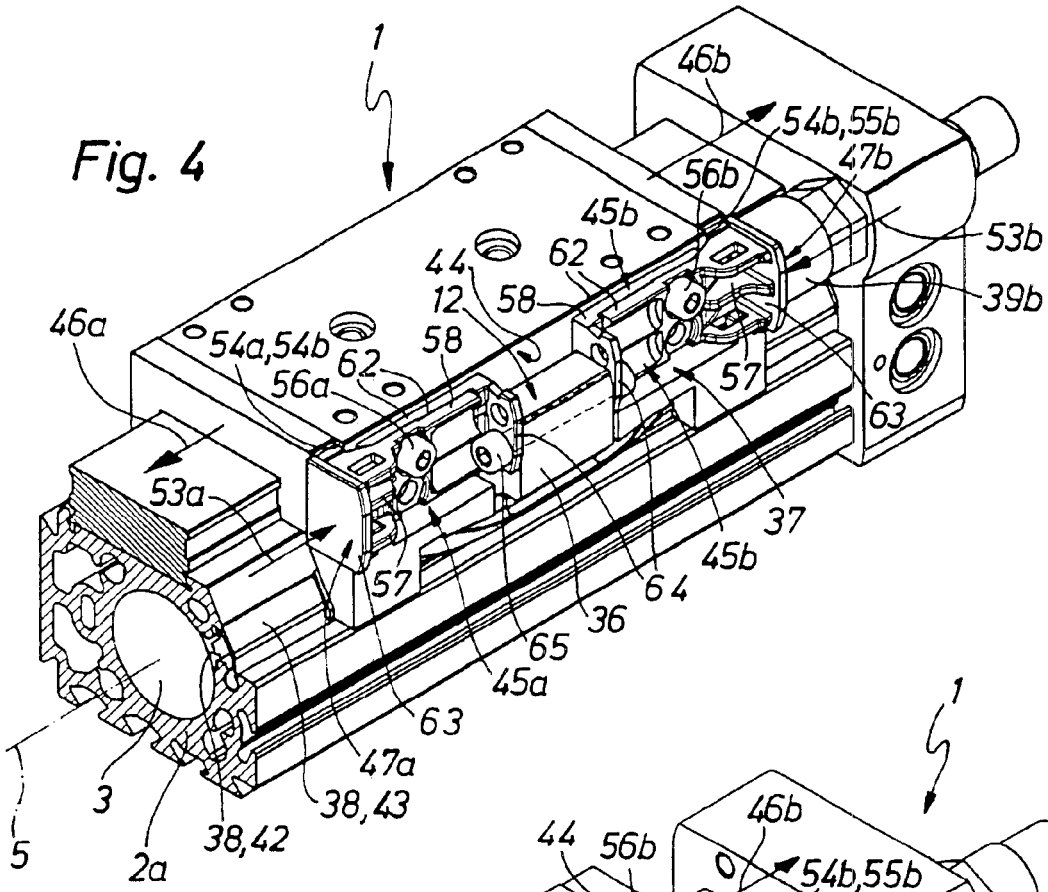
FIG. 4 is a representation, corresponding to FIG. 2, of part of the linear drive, a covering part having been removed so that the individual components are more readily visible.
Figure 5:
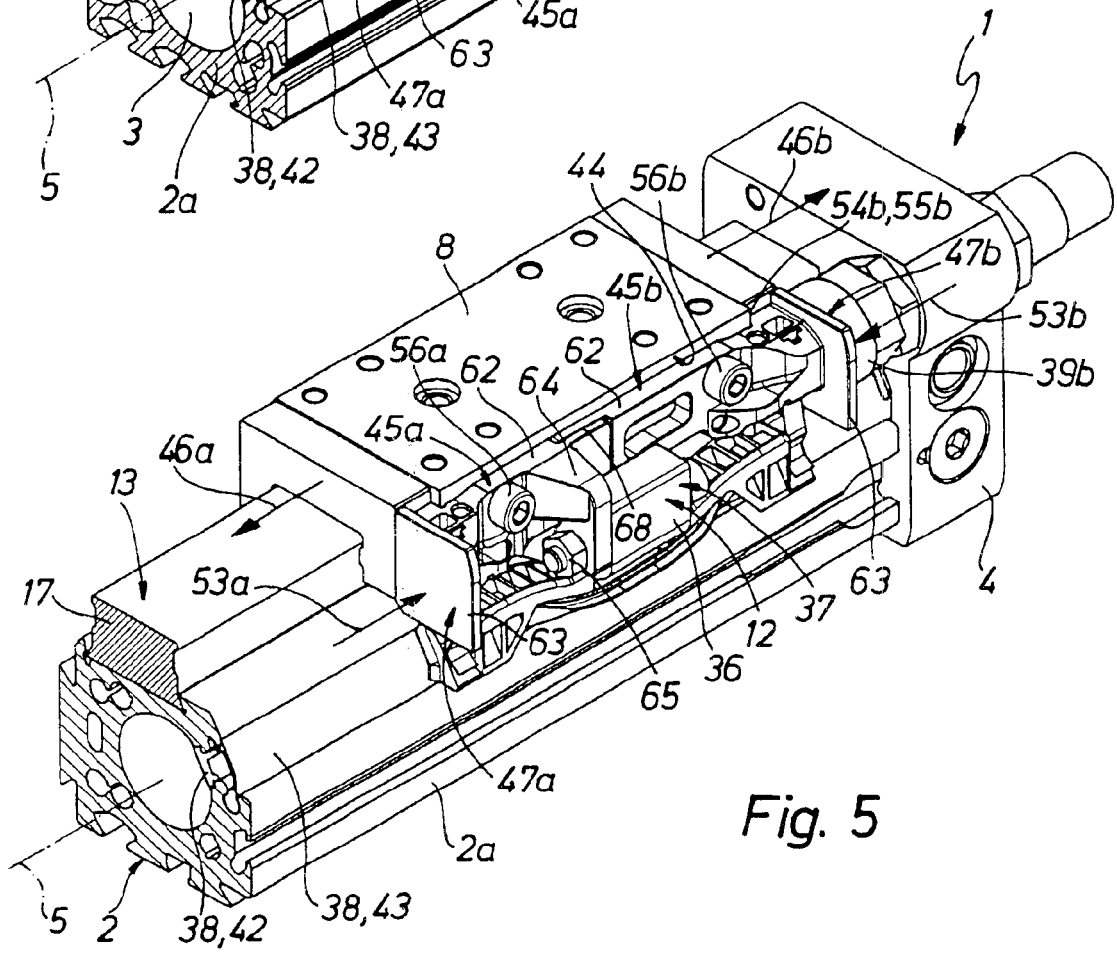
FIG. 5 is a view similar to that of FIG. 4 of a linear drive with a modified design of the abutment means.

FIGS. 4 and 5 show two alternative embodiments of the abutment means 37, the following description applying for both unless stated otherwise, mutually corresponding components being provided with the same reference numerals.

The abutment means 37 comprises two individual abutment units 45*a* and 45*b*, which—one after the other in the longitudinal direction 5 of the housing—are mounted independently of each other on the mounting face 44.

During the operation of the linear drive 1 the ganged unit comprising the drive part 6, the entraining member 12, the abutment means 37 and the guide slide 8, may be shifted in two opposite directions 46*a* and 46*b* of movement in relation to the housing 2, the directions being parallel to the longitudinal direction 5 of the housing. Of the two abutment units 45*a* and 45*b* one respective one is responsible for limiting movement in one of the two directions 46*a* and 46*b* of movement. The one, first abutment unit 45*a* has a further first abutment face 47*a* facing in a first movement direction 46*a*, whereas other, second abutment unit 45*b* has a second abutment face 47*b* facing in the other second direction 46*b* of movement.

When the guide slide 8 reaches one of its two possible end positions adjacent to the cover plate 4, the abutment face 47*a*, respectively, 47*b* now facing in the current direction of movement, will strike a first and, respectively, second counter abutment face 48*a* and 48*b* arranged in its path of motion and facing it, such counter abutment face being provided on one of the above mentioned counter abutments 39*a* and 39*b* secured to the housing. The counter abutments 39*a* and 39*b* are associated with the two end regions of the housing 2 and in the working example attached to the cover plates 4, which—at least adjacent to the counter abutments 39*a* and 39*b*-project past the periphery of the housing tube 2*a*.

In the working embodiment the counter abutments 39*a* and 39*b* each comprise a shock absorber 52 serving for damping the terminal impact of the ganged unit, the counter abutment faces 48*a* and 48*b* being provided on a shock absorber element able to move to a limited extent. As an alternative such shock absorbers 52 could be part of the respectively associated abutment unit 45 and 45*b*. Furthermore, a design without shock absorbers 52 is possible, more particularly in connection with other means such as rubber buffers or the like serving to reduce impact.

The two designs of abutment means 37 in FIGS. 4 and 5 basically differ to the extent that in the case of FIG. 4 the entraining member 12 is secured to both abutment units 45*a* and 45*b*, whereas in accordance with FIG. 5 it is only fixed to the one, first abutment unit 45*a*.

The two embodiments share the feature that the two abutment units 45*a* and 45*b* are supported, at least in the direction of the impact force 53*a* and 53*b* acting on them at impact on a counter abutment 39*a* and 39*b*, in an interlocking manner on the guide slide 8. Each abutment unit 45*a* and 45*b* possesses a support face 54*a* and 54*b* facing in the direction of the impact force 53*a* and 53*b* acting on them, such face resting against a facing counter abutment face 55*a* and 55*b* of the guide slide 8.

In the working embodiment the support face 54*a* and 54*b* is constituted by a step of the respective abutment unit 45*a* and 45*b*, and the respectively associated counter abutment face 55*a* and 55*b* is located at a corner part of the guide slide 8, more especially at its front and rear ends.

If now one abutment unit 45*a* and 45*b* strikes a counter abutment 39*a* and 39*b*, the impact force 53*a* and 53*b* will be transmitted directly by way of the engaging support and counter support faces 54*a* and 54*b* and, respectively, 54*a* and 54*b* to the guide slide 8, whereas the entraining member 12 and accordingly furthermore the drive part coupled with it will be uncoupled as regards forces.

The two working embodiments furthermore share the feature that the separately produced abutment units 45*a* and 45*b* are arranged to the guide slide 8 independently of one another—that is to say by the first and second attachment means 56*a* and 56*b* something which provides the possibility during assembly of adjusting the position of the two abutment units 45*a* and 45*b* in relation to each other and furthermore in relation to the guide slide 8. Accordingly any departures in position between the entraining member 12 and the guide slide 8 may be taken into account without producing strains within the ganged unit.

In the working embodiment illustrated in FIG. 4 the two abutment units 45*a* and 45*b* are respectively made in two parts. They each comprise an abutment part 57 provided for cooperation with one of the counter abutments 39*a* and 39*b* and accordingly having one of the abutment faces 47*a* and 47*b*, and furthermore a separate holding part 58 provided for the attachment of the entraining member 12. These two parts 57 and 58 are able to be reset in their relative position during assembly on the guide slide 8 in the longitudinal direction 5 of the housing in order to ensure an adaptation of the relative position between the entraining member 12 and the guide slide 8.

The abutment part 57 and the holding part 58 are preferably L-like in form. They each have an attachment limb 62, such limbs being aligned in the longitudinal direction 5 of the housing and overlapping a certain distance in the longitudinal direction 5 of the housing. The attachment limb 62 of the holding part 58 rests against the attachment face 44 and is accordingly seated between the guide slide 8 and the attachment limb 62, covering it, of the abutment part 57. This arrangement could also be reversed.

In the case of the abutment part 57 the second limb is an abutment limb 63 having an abutment face 47*a* and 47*b* and in the case of the holding part 58 it is a holding limb 64 serving for the attachment of the entraining member 12. The abutment limb 63 and the holding limb 64 respectively extend in a transverse housing plane, which is at a right angle to the longitudinal direction 5 of the housing, away from the guide slide 8 and are located on opposite end regions of the respective abutment unit 45*a* and 45*b*. The holding limbs 64 of the two abutment units 45*a* and 45*b* are accordingly turned toward one another whereas the abutment limbs 63 face away from the one another. Generally the abutment units 45*a* and 45*b* therefore have a U-like shape.

The coupling section 36 of the entraining member 12 fits between the two holding limbs 64 and is connected in a play-free manner with the two holding limbs 64 in the longitudinal direction 5 of the housing.

In order to produce the play-free connection, the two holding parts 58 are thrust by a screw connection 65 against the two end faces, aligned oppositely in the longitudinal direction 5 of the housing, of the coupling section 36. This is performed at a point in time at which the abutment part 57 and the holding part 58 are still movable in relation to each other in the longitudinal direction 5 of the housing, because the first and the second attachment means 56*a* and 56*b* are not yet drawn tight. These first and second attachment means 56*a* and 56*b* are preferably constituted by attachment screws and provided for common attachment of the parts 57 and 58 of each abutment unit 45*a* and 45*b*.

In the working embodiment the screw connection 65 is in the form of a screw 66 which bears against the two holding limbs 64 and the coupling section 36.

In order to ensure that during assembly inaccurate positioning of the entraining member 12 and the guide slide 8 may be compensated for, the screw 66 extends through a through hole 67 in the 12, such hole having a larger cross section than the screw 66 extending through it so that there is play on all sides. The hole 67 may be in the form of a slot. The entraining member 12 is accordingly able to be set in a housing plane, at a right angle to the longitudinal direction 5 of the housing, in various different relative positions on the abutment units 45*a* and 45*b*.

After the entraining member 12 has been secured to the holding parts 58 and the abutment parts 57 have been moved into a position in which their support face 54*a* and 54*b* rest against the counter support faces 55*a* and 55*b*, the attachment means 56*a* and 56*b* are operated and accordingly the entire abutment means is fixed on the guide slide 8.

It will be clear that the abutment parts 57 may be fixed in the desired position even if there are inaccuracies as regards the distance apart of the entraining member 12 and the guide slide 8 in the longitudinal direction 5 of the housing. The departures are readily compensated for by varying the degree of overlap between the attachment limbs 62.

In order to permanently set the relative position between the entraining member 12 and the guide slide 8 in the longitudinal direction 5 of the housing and to meet exacting requirements, it is to be recommended to provide an additional interlocking connection between the abutment part 57 and the holding part 58 of a respective abutment unit 45*a* and 45*b*. This interlocking connection is produced after the components have been fixed in position in the manner indicated by the screw connection 65 and the attachment means 56*a* and 56*b*. In this case the simplest method is to provide a bond using an adhesive, which is as a preliminary is applied to the contact faces of the two attachment limbs 62, such adhesive then setting in the course of time.

As an alternative it would for instance be possible to have a weldment, more particularly a laser weld, if the abutment part 57 and the holding part 58—as is preferred—each consist of plastic material.

In the working embodiment illustrated in FIG. 5 the two abutment units 45*a* and 45*b* are respectively integral in design. The basic configuration may be the same as that of the abutment parts 57, there being an attachment limb 62 for fitting to the mounting face 44 and an abutment limb 63 having the abutment 47*a* and 47*b*. Unlike the case of FIG. 4 however for the attachment of the entraining member 12 there is only one abutment unit 45*a* with a holding section, which is more especially in the form of a holding limb 64, such section not being part of a separate component but being made integrally with the attachment limb 62 of the respectively first abutment unit 45*a*.

By means of a screw connection 65 the entraining member 12, which again has a corresponding through hole 67, is fixed on the face, facing the second abutment unit 45*b*, of the holding limb 64. Such attachment is preferably again performed on installation of the abutment unit 37, after the abutment units 45*a* and 45*b* have already been preliminarily fixed by the first and the second attachment means 56*a* and 56*b*, in relation to each other and in relation to the guide slide 8 yet still in the longitudinal direction 5 of the housing to allow for adjustment. Then the two abutment units 45*a* and 45*b* are independently adjusted so that their support faces 54*a* and 54*b* engage the respective with counter support face 55*a* and 55*b*. In this case the attachment limbs 62 overlap in an overlap portion 68 to a greater or lesser extent. Then the attachment means 56*a* and 56*b* are tightened in order to produce the desired frictional connection between the abutment units 45*a* and 45*b* and the guide slide 8.

In order to meet cases of heavy loading and ensure that the second abutment unit 45*b* not directly attached to the entraining member 12 may also participate in force transmission, the two abutment units 45*a* and 45*b* are preferably welded or bonded in the overlap zone 68. In this case as well a bond is preferred using an adhesive which is applied in the overlap zone 68 as a preliminary on facing faces of the attachment limbs 62, such adhesive then later hardening after the abutment units 45*a* and 45*b* have been fixed in position by the attachment means 56*a* and 56*b*.

Accordingly in both embodiments the abutment units 45*a* and 45*b* both take part in force transmission between the entraining member 12 and the guide slide 8. Both working examples share the feature that there is no direct connection between the 12 and the guide slide 8.

Figure 2:
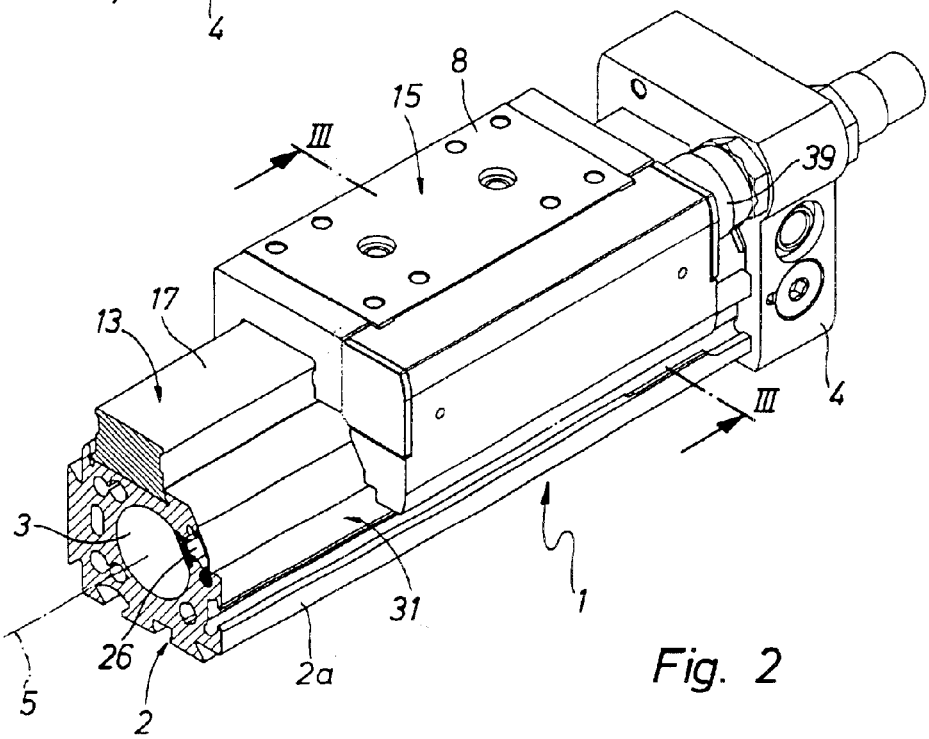
FIG. 2 represents part of the linear drive of FIG. 1 on a slightly larger scale, the housing being sectioned in order to show the cross section or outline.

FIGS. 1 through 3 furthermore show a hood 72, which is omitted in FIGS. 4 and 5, and which is installed during use of the linear drive and—with the exception of the abutment faces 47*a* and 47*b* and, respectively, the abutment limbs 63 having them—covers all further components of the abutment unit 37. Preferably the transverse dimensions of the hood 72 are so selected that it extends furthermore over the length section, located at the same level as the longitudinal direction 5 of the housing, so that the entraining member 12 as well is covered and no dirt may find its way into the entraining member 12 where the entraining member 12 emerges from it. The hood 72 may for instance be detachably mounted using attachment screws 73. Alternatively a detent or catch would be possible.

What claimed is:

1. A piston rod-less linear drive comprising an elongated housing defining a receiving space for a drive part able to be moved in the longitudinal direction of the housing, such drive part being kinematically coupled by way of a entraining member, extending through a longitudinal slot in the housing, with a guide slide, which runs in the longitudinal direction of the housing on a linear guide attached to the housing, wherein the entraining member is coupled with the guide slide with the interposition of an abutment means, which is secured to the guide slide and is made separately from the guide slide, the abutment means on the one hand cooperating with counter abutments on the housing for limiting the setting movement of the guide slide and on the other hand transmitting the drive force from the entraining member to the guide slide in a manner free of play.

2. The linear drive as set forth in claim 1, wherein the abutment means is arranged on a side face of a guide slide, such slide having a substantially rectangular plan.

3. The linear drive as set forth in claim 1, wherein the abutment means includes two individual abutment units, which are responsible for limiting the setting movement in one respective one of the two possible directions of motion of the guide slide, the entraining member being attached to only one or to both of the abutment units.

4. The linear drive as set forth in claim 3, wherein the two abutment units are arranged in sequence in the longitudinal direction of the housing.

5. The linear drive as set forth in claim 3, wherein the two abutment units are secured to the guide slide independently of each other and are preferably able to be adjusted during assembly in the longitudinal direction of the housing in relation to one another.

6. The linear drive as set forth in claim 3, wherein the two two abutment units are respectively supported at least in the direction of impact against a counter abutment, as regards impact force acting on them, in an interlocking manner on the guide slide.

7. The linear drive as set forth in claim 6, wherein each abutment unit comprises at least one support face facing in the direction of the impact force, such support face resting against a facing counter support face of the guide slide.

8. The linear drive as set forth in claim 7, wherein the support face is constituted by a step on the respective abutment unit.

9. The linear drive as set forth in claim 8, wherein the counter abutment face is provided in a corner portion of the guide slide having an essentially rectangular plan.

10. The linear drive as set forth in claim 3, wherein in the case of an attachment of the entraining member on only one abutment unit, the two abutment units, in the complete, installed state are so firmly fixed together that between them transmission of force in the longitudinal direction of the housing is possible.

11. The linear drive as set forth in claim 10, wherein the two abutment units are welded or bonded to sections overlapping in the longitudinal direction of the housing and more particularly are bonded at the join.

12. The linear drive as set forth in claim 3, wherein in the case of an attachment of the entraining member to only one abutment unit the respective abutment unit is of integral construction.

13. The linear drive as set forth in claim 3, wherein in the case of attachment of the entraining member to both abutment units the two abutment units respectively possess an abutment part provided for cooperation with a counter abutment and a holding part provided for attachment of the entraining member, the two parts of a respective abutment unit being able to be adjusted during assembly in relation to each other in the longitudinal direction of the housing.

14. The linear drive as set forth in claim 13, wherein the abutment part and the holding part are connected together by welding or more particularly by bonding in the completely installed state.

15. The linear drive as set forth in claim 13, wherein each respective abutment unit the two parts are secured together by common attachment means on the guide slide.

16. The linear drive as set forth in claim 13, wherein the entraining member has a coupling section fitting between the holding parts spaced apart in the longitudinal direction of the housing and being connected with both holding parts in a play-free manner.

17. The linear drive as set forth in claim 16, wherein the coupling section is clamped by a screw connection between the two holding parts in a play-free manner.

18. The linear drive as set forth in claim 13, wherein the two parts of a respective abutment unit are L-like in form and are each arranged with overlap on an attachment limb so that the abutment unit has a U-like configuration, the one limb having an abutment face provided for cooperation with a counter abutment and the other limb serving for attachment of the entraining member.

19. The linear drive as set forth claim in 3, wherein the attachment means provided for the attachment of the entraining member are so designed that the entraining member is able to be attached on the associated abutment unit in a transverse plane of the housing perpendicular to the longitudinal direction of the housing in adjustable relative positions.

20. The linear drive as set forth claim in 1, wherein at its two oppositely placed longitudinal sides the linear guide has guide sections cooperating with the guide slide, such guide sections defining the guide plane, with reference to which the slot plane containing the longitudinal slot extends at an acute angle obliquely, the abutment unit being mounted at the same level as the guide plane to the side on the guide slide.

21. The linear drive as set forth claim in 1, in a design adapted for fluid power operation in the case of which the drive part is a fluid actuated piston and in the case of which the longitudinal slot is provided with a band-like sealing means.

* * * * *